US006739385B2

(12) United States Patent
Brenner et al.

(10) Patent No.: US 6,739,385 B2
(45) Date of Patent: May 25, 2004

(54) PLATE-TYPE HEAT EXCHANGER

(75) Inventors: Martin Brenner, Kieselbronn (DE); Herbert Damsohn, Aichwald (DE); Conrad Pfender, Besigheim (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 09/942,773

(22) Filed: Aug. 31, 2001

(65) Prior Publication Data

US 2002/0023741 A1 Feb. 28, 2002

(30) Foreign Application Priority Data

Aug. 31, 2000 (DE) ..... 100 42 690

(51) Int. Cl.[7] ..... F28F 3/08
(52) U.S. Cl. ..... 165/166; 165/DIG. 382
(58) Field of Search ..... 165/166, 167

(56) References Cited

U.S. PATENT DOCUMENTS

| | | | | | |
|---|---|---|---|---|---|
| 1,932,950 | A | * | 10/1933 | Annis | 165/157 |
| 2,912,749 | A | * | 11/1959 | Bauerfeind et al. | 165/153 |
| 2,959,401 | A | | 11/1960 | Burton | 257/245 |
| 3,331,435 | A | * | 7/1967 | Valyi | 165/135 |
| T0,911,013 | I4 | * | 6/1973 | Morgans et al. | 165/166 |
| 3,967,354 | A | * | 7/1976 | Jaspers | 165/166 |
| 4,362,209 | A | * | 12/1982 | Cleveland | 165/166 |
| 4,501,321 | A | * | 2/1985 | Real et al. | 138/157 |
| 4,527,622 | A | * | 7/1985 | Weber | 165/166 |
| 4,579,172 | A | * | 4/1986 | Carlsson | 165/167 |
| 4,681,155 | A | * | 7/1987 | Kredo | 138/163 |
| 5,342,706 | A | * | 8/1994 | Marianowski et al. | 429/35 |
| 6,013,385 | A | * | 1/2000 | DuBose | 429/17 |

FOREIGN PATENT DOCUMENTS

| | | |
|---|---|---|
| DE | 197 07 648 | 8/1998 |
| DE | 198 15 218 | 10/1999 |
| DE | 199 09 881 | 9/2000 |

OTHER PUBLICATIONS

"Cross Flow Energy Exchanger for Energy Recovery from Air Flows", by Bernd Lamb, Oberschüler 75 Karlsruhe 31 Lindenweg 13, 7533008, Mar. 11, 1976.

* cited by examiner

*Primary Examiner*—Allen Flanigan
(74) *Attorney, Agent, or Firm*—Foley & Lardner

(57) ABSTRACT

The invention relates to a plate-type heat exchanger having a plate block comprising partition plates which delimit flow channel layers between the plates. According to the invention, the partition plates have a solid or folded edge, which projects out of the plane of at least one main side of the partition plates at the edge side, along closed-edge regions which are spaced apart from one another in the peripheral direction by means of intervening open-edge regions. In the plate block, this solid or folded edge is joined in a fluid-tight manner to the opposite edge region of an adjoining partition plate and functions as a lateral boundary for the associated flow channel layer. Such heat exchangers may be used, for example, in automobiles and reactors of fuel cell systems.

20 Claims, 4 Drawing Sheets

PLATE-TYPE HEAT EXCHANGER

BACKGROUND OF THE INVENTION

1. Field of the Invention

The invention relates to a plate-type heat exchanger having a plate block or a stack of partition plates, which delimit flow channel layers between them. In other words, the partition plates serve as fluid-separating walls between successive flow channel layers in the stack direction. These successive flow channel layers usually comprise two or more different liquid or gaseous heat transfer media which are to be brought into thermal contact with one another. The heat transfer media usually flows through the channels in an alternating manner. The partition plates, preferably, have a good thermal conductivity.

2. Description of Related Art

A plate-type heat exchanger is described in commonly asssigned, earlier German patent application 199 09 881. The crosscurrent-type heat exchanger described therein includes partition plates, into which shaped-out moldings are formed. Regions of the partition plates in the plate block are in contact with adjacent partition plates by means of the shaped-out moldings, In each instance, adjacent partition plates are spaced apart by the shaped-out molding regions and thereby form the boundaries for a flow channel layer, in the stack direction, between the partition plates. In side regions, the partition plates are provided with inlet-channel and outlet-channel apertures. Through the aligned overlap of these apertures on the edge side of the stack, manifold channels which open out at the end sides of the stack are formed. These manifold channels serve the purpose of distributing the respective heat-transfer medium to the corresponding flow channel layers and for collecting the heat-transfer medium which leaves the flow channel layers.

The documents DE 197 07 648 A1 and DE 198 15 218 A1 have described plate-type heat exchangers. The stacked structure of these heat exchangers includes flat plates of different types. Specifically, these flow channel plates include plates which are provided with apertures which form flow channels, as well as partitioning intermediate plates which are arranged alternately with the flow channel plates in the stack and serve as partitions for the flow channels of the flow channel plates. Depending on the particular embodiment, lateral manifold apertures which overlap one another in an aligned manner in the stack are made in all the plates. This forms corresponding manifold channels which open out at the end sides of the stack. Alternatively, the flow channels of the flow channel plates, in both end regions, extend beyond the intermediate or partition plates. As a result, a connection structure is formed, in which the relevant heat-transfer medium can be fed laterally to the stack and removed therefrom. In the process, on the relevant stack sides of the intermediate plate planes, the heat transfer medium passes into the protruding flow channels of the flow channels plates and, in a corresponding manner, passes out of them again.

SUMMARY OF THE INVENTION

In accomplishing the objects of the invention, there has been provided according to one aspect of the invention a plate heat exchanger comprising a plurality of partition plates arranged (i) to form a plate block or a plate stack and (ii) to delimit, in alternating directions, layers of flow channels between adjacent partition plates within said plurality of partition plates; wherein a first partition plate comprises (a) a first main side; (b) a second main side; (c) a first solid or folded edge which projects out of the plane of at least one of said main sides; and (d) a second solid or folded edge, opposite said first solid or folded edge, which projects out of the plane of the same main side as and in the same direction as said first solid or folded edge; a second partition plate joined to said first partition plate in a fluid-tight manner along said first and second solid or folded edges and spaced apart from said first partition plate by said first and said second solid or folded edges, thereby defining a flow channel layer between said first partition plate and said second partition plate.

According to another aspect of the invention, there is provided a plate heat exchanger comprising a plurality of partition plates arranged in a stack, wherein each partition plate comprises (a) a center portion; (b) a first edge region having a thickness greater than a thickness of said center portion; and (c) a second edge region, opposite said first edge region, having a thickness greater than a thickness of said center portion; and wherein each plate is joined to an adjacent plate along said first edge region and said second edge region thereby defining a flow channel between each plate and an adjacent plate; and wherein successive plates within said stack are arranged at an angle of 90° relative to a previous partition plate thereby defining flow channels in a first direction and a second direction.

Further objects, features and advantages of the present invention will become apparent from the detailed description of preferred embodiments that follows when considered together with the accompanying drawings.

BRIEF DESCRIPTION OF THE DRAWINGS

The invention is explained in detail below with reference to the exemplary embodiments and with reference to the accompanying drawings, in which.

DETAILED DESCRIPTION OF PREFERRED EMBODIMENTS

Figure 1:
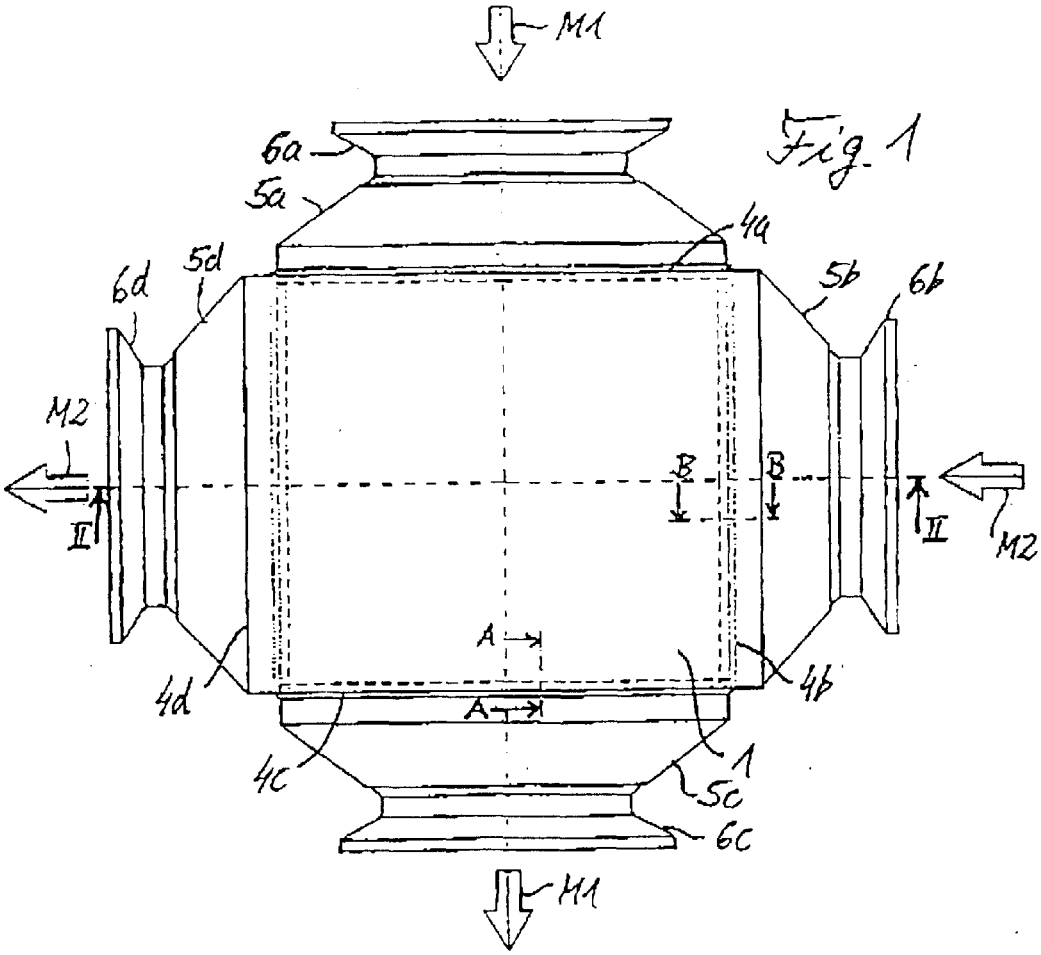
FIG. 1 shows a plan view of a crosscurrent plate-type heat exchanger with a stack of square partition plates.

The invention is based on the technical problem of providing a plate-type heat exchanger of the type described in the introduction which can be produced with relatively little outlay and with a reliable seal, which has advantageous flow characteristics for the heat-transfer media which are to be passed through it and which, in particular, allows the heat-transfer media to be supplied to and discharged from the sides with little pressure loss.

The invention solves this problem by providing such a plate-type heat exchanger. In the plate-type heat exchanger of the invention, the plate block is constructed from partition plates which are thickened at the edges by a suitable solid or folded edge. The partition plates are joined in a fluid-tight manner to the opposite edge region of an adjacent partition plate by means of their thickened solid or folded edge. In the remaining area, respective adjacent partition plates are held apart from one another, at least partially, so as to define the boundaries of a flow channel layer on both sides and in the stack direction. Thereby, depending on the selected internal structure, one or more flow channels through which medium can flow in parallel are formed transversely with respect to the stack direction. The thickened solid or folded edge defines the lateral boundaries of the flow channel layer in the relevant edge regions. Such edge regions are, therefore, referred to herein as closed-edge regions while the other edge regions, in which the flow channel(s) open(s) out laterally, are referred to as open-edge regions.

This partition-plate, plate block structure can be produced with relatively little outlay by means of partition plates which are simple to manufacture. The loss of material when manufacturing the partition plates can be kept at a very low level. Since the various heat-transfer medium flow channels open out laterally in the planes of the flow channel layers themselves, the respective heat-transfer medium can be supplied and discharged with a flow profile exhibiting a relatively high level of linearity. As a result, there is a low pressure loss laterally at the plate block with a flow component running substantially transversely with respect to the stack direction, i.e. with respect to the plate block longitudinal axis. After the partition-plate, plate block structure has been manufactured, suitable manifolds can be fitted laterally thereto. Before this, the individual partition plates may be fixed to one another in a fluid tight manner, for example by laser welding, brazing or adhesive bonding, along the solid or folded edges which are freely accessible from the sides.

In an alternative configuration of the invention, the solid or folded edge is provided either on only one of the main sides of the partition-plate or on both of the main sides of the partition-plate. In the latter case, the solid or folded edge, with respect to the orientation of the side regions in the plate block, is provided on different edge regions on one partition-plate main side from that on the other main side. Accordingly, by placing solid or folded edges of two successive partition plates against one another, it is possible to form alternating flow channel layers for two or more heat-transfer media, which can be supplied and discharged, respectively, on different regions of the plate block.

In yet another configuration of the invention, the plate block structure comprises quadrilateral partition plates which follow one another in the plate block, in each case rotated through 90° or tilted through 180°. In this way, it is possible to produce a two-media plate-type heat exchanger of the crosscurrent type, in which the two heat-transfer media are guided through the plate block in crosscurrent, alternating layers, and only a single type of partition plate is required.

According to an alternative configuration of the invention, a folded edge is provided on the partition plates which, depending on requirements, is produced as a single fold for smaller flow channel heights or as a multiple fold for greater flow channel heights.

In a plate-type heat exchanger according to a refinement of the invention, manifolds are laterally attached to the plate block for supplying and discharging the heat-transfer media.

Figure 2:
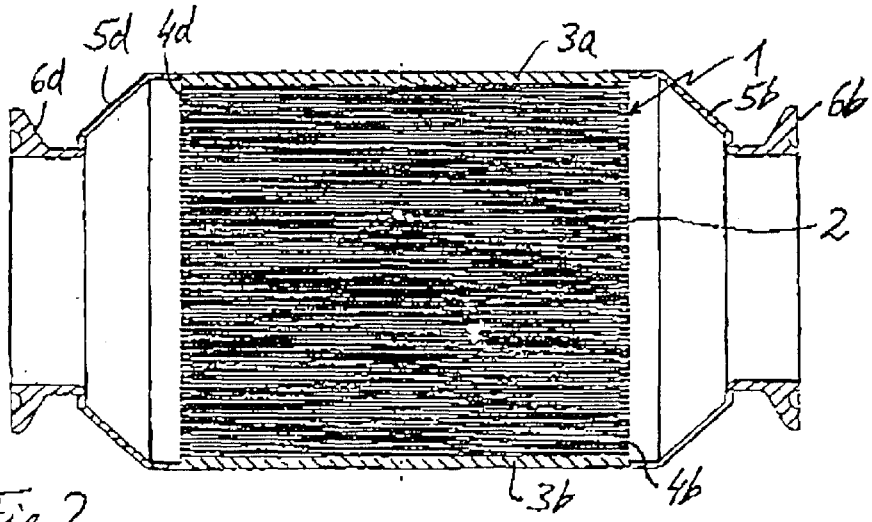
FIG. 2 shows a longitudinal section on line 11—11 from FIG. 1.

Turning now to the drawings, FIGS. 1 and 2, respectively, show a plan view and a longitudinal sectional view of a crosscurrent, plate-type heat exchanger which has a plate block or stack 1 of quadrilateral partition plates 2 between two cover plates 3*a*, 3*b* on the end sides of the stack. One manifold 5*a* to 5*d* with associated connection piece 6*a* to 6*d* is attached to each of the four side faces 4*a* to 4*d* of the partition plate stack 1, which is in the shape of a cube or cuboid. Each manifold 5*a* to 5*d* surrounds the entire corresponding stack side face 4*a* to 4*d*. Two liquid or gaseous heat-transfer media M1, M2 which are to be brought into thermal contact in the partition plate stack 1 are passed in crosscurrent through alternating flow channel layers which are defined by the partition plates 2. For this purpose, they are introduced, in each case offset by 90°, into a corresponding manifold 5*a*, 5*b* via corresponding connection piece 6*a*, 6*b* which serves as an inlet connection piece. From this manifold, heat transfer media M1, M2 are each distributed to alternate flow channel layers, are passed through these layers and, on the opposite side, are collected again in the manifolds 5*c*, 5*d* which are present at these sides and are discharged via the associated connection pieces 6*c*, 6*d* which act as discharge connection pieces.

The partition plates 2 consist of, for example, a metal or plastic material of good thermal conductivity. The partition plates 2 are used, first, for fluid separation and, second, for heat transfer between two respective flow channel layers which follow one another in the stack direction. Specifically, the flow channel layers are formed by the fact that the partition plates 2 have thickened edge zones on two opposite edges of at least one of their main sides. It is optionally possible for thickened edge zones to be provided on the other main side, along the two other, opposite side edges. At any rate, adjacent partition plates 2 in the stack 1 are in contact with one another only along the thickened edge zones, where they are joined together in a fluidtight manner. In the remaining region, they maintain a suitable distance from one another and, as a result, define a flow channel layer between them. If no other internal structure is introduced, this layer forms a single-part flow channel. If necessary, the flow channel layer may have an inner structure. For example, the flow channel layer may be divided into a plurality of parallel flow channels, such as by means of webs, and/or may include flow-guiding surfaces or elements which promote heat transfer, for example corrugated fins.

Depending on the particular application, the thickened edge zones of the partition plates 2 may be designed as a solid edge or a folded edge. In the case of a solid edge, corresponding techniques are used to ensure that the material forming the volume of the partition plate remains thicker in the relevant edge-zone regions than in the remaining regions. In the case of the folded edge, a partition plate blank of standard thickness is prefabricated with edge-side fold extensions in the desired edge-zone region, and these extensions are then folded over onto the actual partition plate surface. Depending on the particular application and the desired height of the flow channel layers relative to the material thickness of the partition plates 2, different designs of partition plates are possible.

Figure 3:
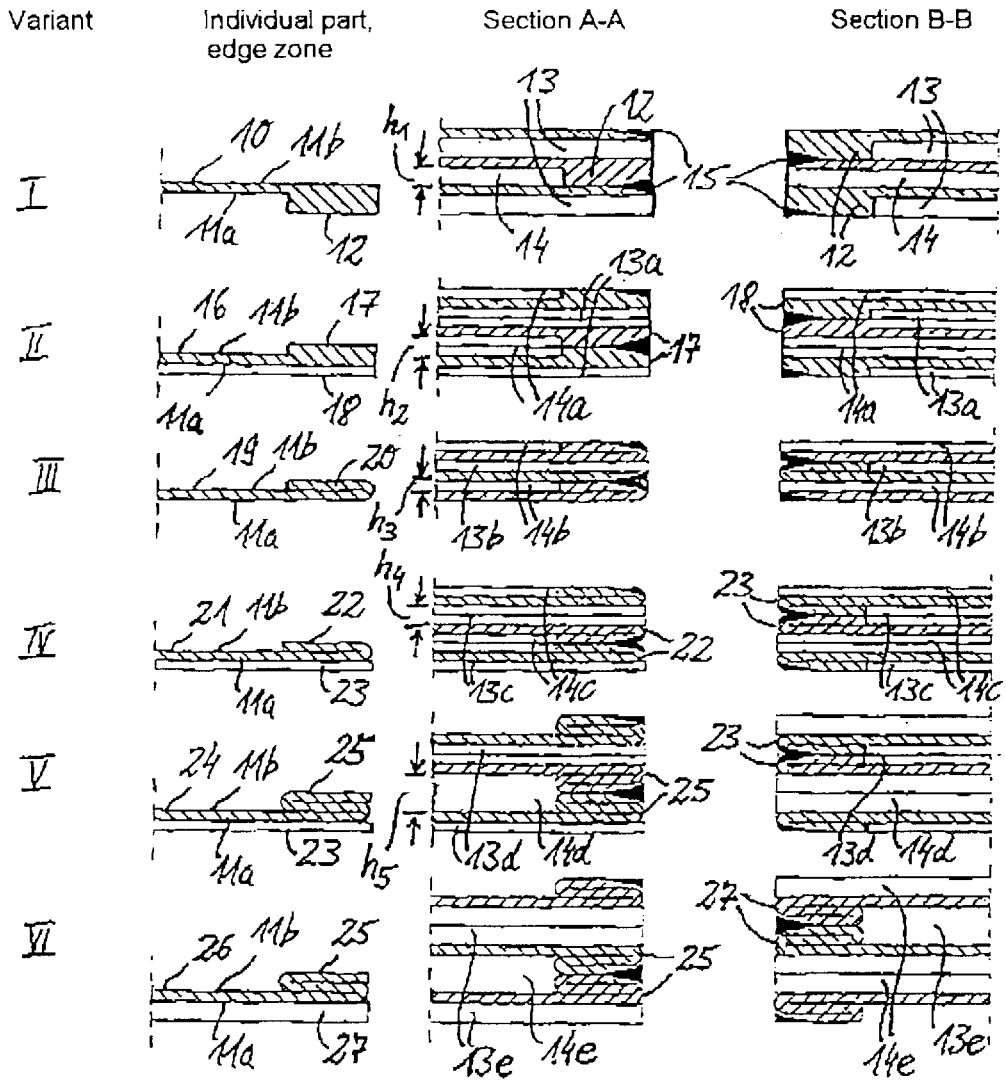
FIG. 3 shows detailed sectional views of individual partition-plate edge zones and of edge zones of a number of successive partition plates on section lines A—A and B—B from FIG. 1, for six different solid-edge or folded-edge variants.

FIG. 3 shows, by way of example, six different partition plate variants, I to VI, in respective sectional illustrations depicting a thickened edge zone region of a partition plate and a few partition plates resting on top of one another and fully assembled in the stack 1, along section lines A—A and B—B in FIG. 1. In each of the six variants, I–VI, only a single type of identically shaped partitioning plate is required to construct the stack 2.

In variant I, square partition plates 10 are each provided with one solid edge 12 as thickened edge zone along two opposite side regions on one main side 11*a*, while the opposite main side 11*b* is planar. To form the plate stack 1, square partition plates 10 designed in this way are successively stacked on top of one another, each rotated through 90°. This results, as can be seen from the two sectional views on lines A—A and B—B, in first flow channel layers 13 for the first heat-transfer medium M1 and second flow channel layers 14 for the second heat-transfer medium M2, which are arranged alternately with respect to the first flow channel layers in the stack direction.

The solid edges 12 define the boundaries, laterally, on opposite stack sides, as seen in the direction of flow of the other heat-transfer medium, i.e. along these closed-edge regions, of flow channel layers 13, 14 for one respective medium. The solid edges 12 also keep the two respective partition plates 10 apart, and, as a result, form flow channel layers 13, 14, of a height $h_1$. The height $h_1$ is the height by which the solid edge 12 projects with respect to the other partition plate surface, since the solid edge 12 of each partition plate bears against the planar main side 11*d* of an adjacent partition plate. This thickened-section height $h_1$ therefore simultaneously represents the height of the flow channel layers 13, 14 which are formed.

To form a fluid-tight joint, each partition plate 10 may be connected in a fluid-tight manner, along its solid edge 12, to the adjoining region of the adjacent partition plate by, for example, laser-welded joints 15. Alternatively, other fluidtight joints, such as, for example brazing, adhesive bonding and/or mechanical clamping, may be considered, depending on the material used for the partition plates and the particular application.

Variant II comprises square or rectangular partition plates 16 which, on both sides, i.e. on both main sides 11*a*, 11*b*, each have two thickened solid edges 17, 18 along opposite side regions. Specifically, each partition plate 16 has solid edges 17 on one main side 11*b* along a first side edge and second side edge, and solid edges 18 on the other main side 11*a* along the third and fourth of the four side edges of the partition plates 16. In this case, in the plate block 1, the partition plates 16 are each stacked on top of one another by opposite solid edges 17, 18 and are joined in a fluid-tight manner, in order once again to form first flow channel layers 13*a* and second flow channel layers 14*a* for the two heat-transfer media M1, M2, in a manner similar to variant I. The height $h_2$ of these flow channel layers 13*a*, 14*a* corresponds to twice the height by which the relevant solid edges 17, 18 project with respect to the remaining region of the partition plates.

Variant III includes square partition plates 19 with a single folded edge 20 on one side, along opposite side edges of the one main side 11*b*, while the other main side 11*a* remains planar. The partition plates 19 of variant III, and the plate block 1 constructed using these plates, consequently corresponds to those shown in variant I. The only difference is that the thickened edge zones are formed by the folded edge 20 instead of a solid edge. Otherwise, reference can therefore be made to the explanations given in connection with variant I, which relates to the formation of the plate block 1 with alternating flow channel layers 13*b*, 14*b* for the two heat-transfer media M1, M2. The folded edge 20 can be produced using a conventional folding technique. In this case, the height $h_3$ of the flow channel layers 13*b*, 14*b* corresponds to the height by which the fold 20 projects with respect to the remaining partition-plate surface and therefore to the thickness of the material of the partition plate 19. Consequently, variant III is particularly suitable for plate blocks with very low, narrow flow channel layers 13*b*, 14*b*.

In variant IV, square or rectangular partition plates 21 are provided, each having two folded edges 22, 23 along opposite first and second side edges of one main side 11*b* and along opposite third and fourth side edges on the other main side 11*a*. In terms of the design of the partition plates 21 and of the plate block formed using these plates, variant IV corresponds to variant II. The only difference is that instead of the solid edges 17, 18 provided in variant II, the folded edges 22, 23 are provided as edge-side thickened sections, in order to form first and second, alternating flow channel layers 13*c*, 14*c* for the two heat-transfer media M1, M2 in the plate block. In this case, the height $h_4$ of the flow channel layers 13*c*, 14*c* corresponds to twice the height by which the folded edges 22, 23 project with respect to the remaining surface of the partition plates, i.e. corresponds to twice the thickness of the material of the partition plates 21.

Figure 4:
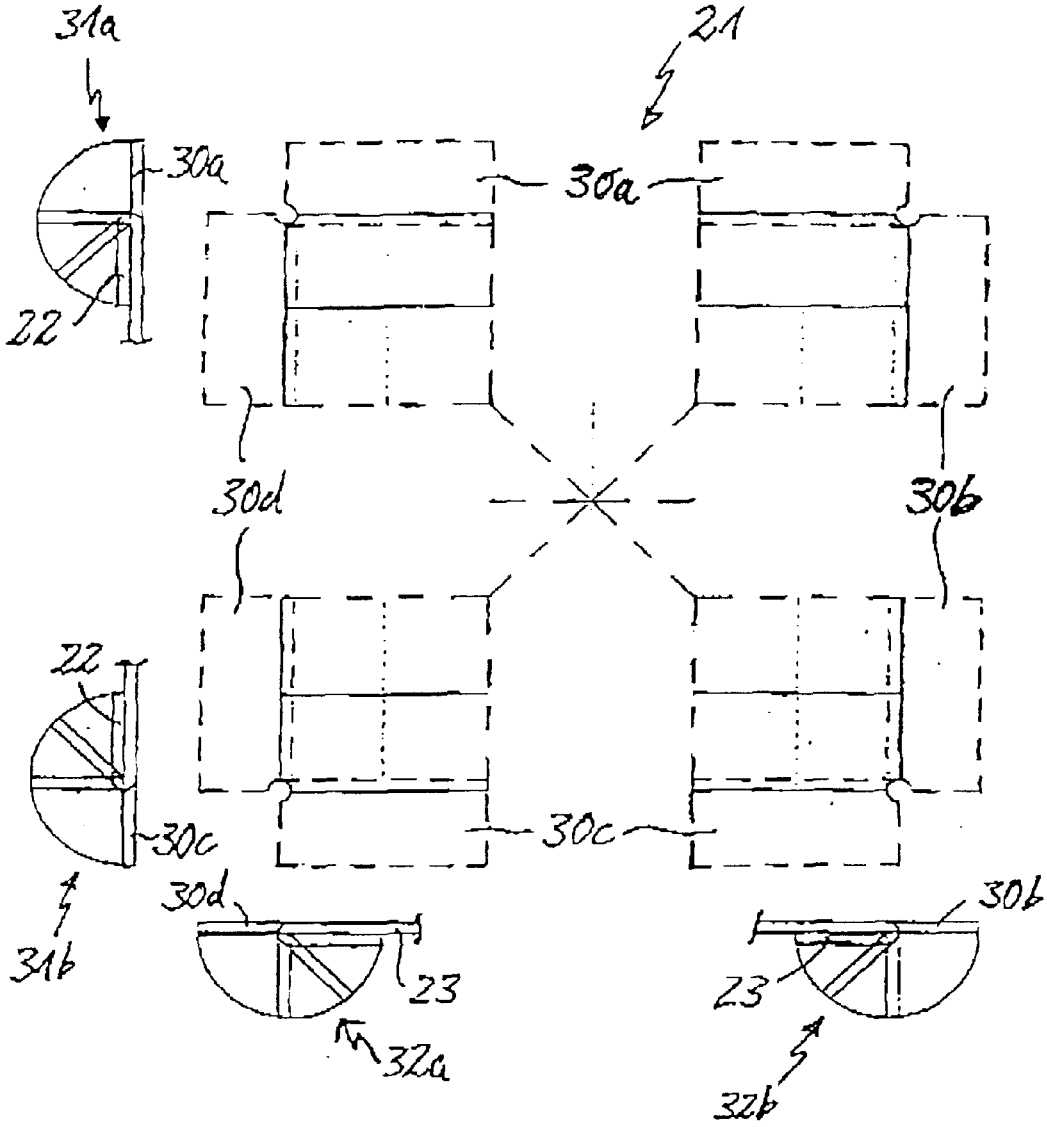
FIG. 4 shows a plan view, with emphasis on the corners, of a partition plate blank, for the purpose of illustrating the formation of single folded edges on both sides, in accordance with one of the variants shown in FIG. 3.
Figure 5:
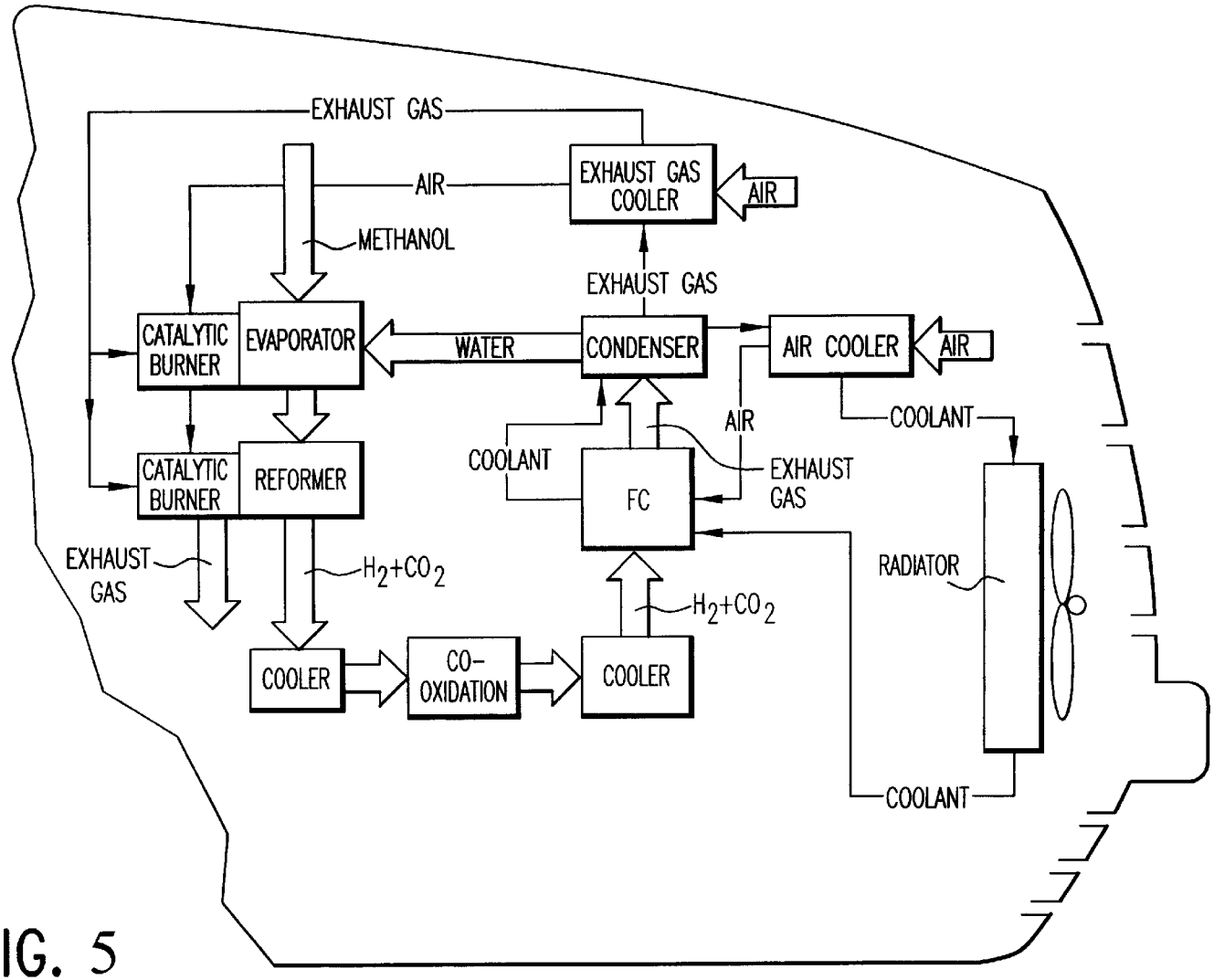
FIG. 5 shows a schematic diagram of a conventional fuel cell power system, e.g., of the type typically used in a motor vehicle.

FIG. 4 illustrates a suitable production operation for a partition plate 21 of this type; for the sake of simplicity, only the four corner regions of the partition plate 21 are shown. As can be seen from FIG. 4, the partition plate 21 is produced from a plate blank which, outside the partition plate basic area, along the four side edges, has in each case one fold section 30*a*, 30*b*, 30*c*, 30*d* projecting therefrom. After this plate blank has been cut to size, first, two opposite fold sections 30*a*, 30*c* are turned up forward out of the plane of the drawing, are tilted over and closed so as to form the two corresponding opposite folded edges 22, as illustrated in two associated fold-bending sketches 31*a*, 31*b*. Then, the two other opposite fold sections 30*b*, 30*d* are turned backward out of the plane of the drawing, are tilted over and are closed to form the two associated opposite folded edges 23, i.e., are bent over through a full 180°, as illustrated in two associated fold-bending sketches 32*a*, 32*b*.

Variant V includes partition plates 24 which correspond to those shown in variant IV, with the exception that on one main side 11*b* double folds 24 are provided instead of the single fold 22 along two opposite side edges. In this way, the height $h_5$ for the flow channel layers 14*d* for one heat-transfer medium which are formed by opposite double folds 24 is increased to double, $2h_4$, the height $h_4$ of the flow channel layers 13*d* for the other heat-transfer medium, and therefore to four times the thickness of the material of the partition plates 24.

Variant VI includes partition plates 26 which correspond to those shown in variant V, except that the thickened edge zones on both main sides 11*a*, 11*b* are formed by respective double folds 25, 27. Consequently, the flow channel layers 13*e*, 14*e* for the two heat-transfer media M1, M2 which are each formed in the plate block 1 by placing double-folded edges against one another have the increased height $h_5$ of four times the thickness of the material of the partition plates.

While the plate-block configurations which are illustrated in the above-described variants I to VI comprise, with the exception of the thickened edge zones, planar, square or rectangular partition plates or partition sheets, it will be understood that, depending on the particular requirements of a given application, modifications are possible with regard to external form of the partition plate and the inner structure of the flow channel layers, such as those which are known from conventional plate-type heat exchangers. For example, internal structures in the form of cross projections, diagonal fins, winglets, etc., or inserted corrugated fin structures, may be provided. In particular, a round shape or other polygonal shape is also possible instead of the quadrilateral shape of the partition plates. The height, length and depth of the flow channel layers can be optimally matched to requirements by suitably designing the solid or folded edges and selecting the dimensions of the partition plates. Typical dimensions may, for example, lie between 30 mm and 300 mm for the edge length of the partition plates and 0.15 mm to 2 mm for the height of the flow channel layers.

The partition plates may preferably be produced from stainless-steel sheet material with a thickness of, for example, less than 0.2 mm. Depending on the particular application, the partition plates with the solid edges may be formed, for example, by stamping, etching, solid-blank forming or injection molding.

Since the heat-transfer media M1, M2 pass into the flow channel layers and out of them again in a virtually linear fashion without major and/or abrupt diversions, via the associated connection pieces 6*a* to 6*d*, the manifolds 5*a* to 5*d* and the open-edge regions of the partition plates 2, at which the flow channel layers open out laterally from the plate block 1, the pressure drop as they flow through the plate block 1 can be minimized, and, in particular, can be kept lower than with connection configurations at the stack end sides. At the same time, the lateral connection configuration is able to offer space and installation advantages. The fact that the connection pieces 6*a* to 6*d* and manifolds 5*a* to 5*d* are separately attached to the plate block 1 eliminates the need for these connection configurations to be produced by designing the partition plates with appropriate apertures. This keeps the consumption of material at a low level and allows the abovementioned linear supply and discharge of the heat-transfer media M1, M2 without abrupt diversions.

Since the manifolds 5*a* to 5*d* together with the connection pieces 6*a* to 6*d* are subsequently attached to the stack 1, the stack side faces 4*a* to 4*d* remain readily accessible for the purpose of forming the laser-welded joints 15. Therefore, it is not imperative to carry out alternating layering and welding operations, but rather the plate block 1 can initially be stacked up completely, and then can be fully welded when held in a single clamp. The welding tracks are readily accessible from the sides and do not require any contour control. The welded plate block can easily undergo nondestructive leak tests and, in this respect, can be reworked if necessary.

The constructed plate block 1 is also readily accessible and testable for any subsequent coating. For example, it can be used for a reactor with a plate-type heat exchanger structure for chemical or thermal reaction processes by providing it with a suitable washcoat catalyst coating, after which the catalyst material is immobilized. Reactors for fuel cell systems form one possible application area.

As a pure heat exchanger, the plate-type heat exchanger according to the invention can be used for a very wide range of applications. Such exemplary applications include, in particular, stationary fuel cell systems, fuel cell vehicles and elsewhere in automotive engineering, for example, as an oil cooler. The design according to the invention allows a plurality of partition-plate, plate blocks to be integrated to form a combined unit without any problems.

The right of priority is claimed based on German Patent Application 100 42 690.5 filed Aug. 31, 2000, the disclosure of which is hereby incorporated by reference in its entirety.

The foregoing embodiments have been shown for illustrative purposes only and are not intended to limit the scope of the invention which is defined by the claims.

What is claimed is:

1. A plate heat exchanger comprising:

a plurality including first, second and third successive partition plates arranged (i) to form a plate block or a plate stack and (ii) to delimit, in alternating directions, a first flow channel between the adjacent first and second partition plates and a second flow channel between the adjacent second and third partition plates, within said plurality of partition plates; wherein a first partition plate comprises:

(a) a first main side;

(b) a second main side;

(c) a first folded edge which projects out of the plane of at least one of said main sides; and (d) a second folded edge, opposite said first folded edge, which projects out of the plane of the same main side as and in the same direction as said first folded edge;

a second partition plate comprises:

(a) a first main side;

(b) a second main side;

(c) a first folded edge which projects out of the plane of at least one of said main sides; and (d) a second folded edge, opposite said first folded edge, which projects out of the plane of the same main side as and in the same direction as said first folded edge, said second partition plate being joined to said first partition plate in a fluid-tight manner along said first and second folded edges of said first partition plate and spaced apart from said first partition plate by said first and said second folded edges of said first partition plate, thereby defining a flow channel layer between said first partition plate and said second partition plate; and wherein each of said folded edges is folded over onto the partition plate surface.

2. A plate heat exchanger comprising:

a plurality of partition plates arranged (i) to form a plate block or a plate stack and (ii) to delimit, in alternating directions, layers of flow channels between adjacent partition plates within said plurality of partition plates; wherein a first partition plate comprises:

(a) a first main side;

(b) a second main side;

(c) a first folded edge which projects out of the plane of at least one of said main sides; and (d) a second folded edge, opposite said first folded edge, which projects out of the plane of the same main side as and in the same direction as said first folded edge;

a second partition plate comprises:

(a) a first main side;

(b) a second main side;

(c) a first folded edge which projects out of the plane of at least one of said main sides; and (d) a second folded edge, opposite said first folded edge, which projects out of the plane of the same main side as and in the same direction as said first folded edge, said second partition plate being joined to said first partition plate in a fluid-tight manner along said first and second folded edges of said first partition plate and spaced apart from said first partition plate by said first and said second folded edges of said first partition plate, thereby defining a flow channel layer between said first partition plate and said second partition plate; and wherein each of said folded edges is folded over onto the partition plate surface, wherein said first partition plate further comprises:

(a) a third folded edge which projects out of the plane of at least one of said main sides in a direction opposite from said first folded edge; and (b) a fourth folded edge, opposite said third folded edge, which projects out of the plane of the same side as and in the same direction as said third folded edge.

3. A plate heat exchanger comprising:

a plurality of partition plates arranged (i) to form a plate block or a plate stack and (ii) to delimit, in alternating directions, layers of flow channels between adjacent partition plates within said plurality of partition plates; wherein a first partition plate comprises:

(a) a first main side;

(b) a second main side;

(c) a first folded edge which projects out of the plane of at least one of said main sides; and (d) a second folded edge, opposite said first folded edge, which projects out of the plane of the same main side as and in the same direction as said first folded edge;

a second partition plate comprises:

(a) a first main side;

(b) a second main side;

(c) a first folded edge which projects out of the plane of at least one of said main sides; and (d) a second folded edge, opposite said first folded edge, which projects out of the plane of the same main side as and in the same direction as said first folded edge, said second partition plate being joined to said first partition plate in a fluid-tight manner along said first and second folded edges of said first partition plate and spaced apart from said first partition plate by said first and said second folded edges of said first partition plate, thereby defining a flow channel layer between said first partition plate and said second partition plate; and wherein each of said folded edges is folded over onto the partition plate surface, wherein said plurality of partition plates comprise quadrilateral partition plates having folded edges arranged on both sides and wherein said plurality of partition plates are interleaved such that adjacent partition plates are rotated through 90° or tilted through 180° relative to one another.

4. A plate heat exchanger according to claim 1, wherein said folded edges comprise at least one fold on each edge.

5. A plate heat exchanger according to claim 1, wherein said folded edges comprise only a single fold on each edge.

6. A plate heat exchanger according to claim 1, wherein said folded edges comprise multiple folds on each edge, tightly stacked on one another.

7. A plate heat exchanger according to claim 2, wherein said folded edges comprise multiple folds on each edge, tightly stacked on one another.

8. A plate heat exchanger according to claim 1, further comprising manifolds attached to lateral sides of said plate block.

9. A plate heat exchanger according to claim 1, wherein each of said plurality of plates is identical.

10. An motor vehicle power system comprising a heat exchanger according to claim 1.

11. A fuel cell system comprising a fuel cell and at least one heat exchanger, wherein the heat exchanger comprises a plate heat exchanger as defined by claim 1.

12. A plate heat exchanger comprising:

a plurality of partition plates arranged in a stack, wherein each partition plate comprises (a) a center portion;

(b) a first edge region having a thickness greater than a thickness of said center portion, said greater thickness comprising a first folded over portion of said partition plate on a first side of the plate; and (c) a second edge region, opposite said first edge region, having a thickness greater than a thickness of said center portion, said greater thickness comprising a folded over portion of said partition plate on the same side of said plate as the first folded over portion; and wherein each of said folded over portions is folded over onto the partition plate surface;

wherein each plate is joined to an adjacent plate along said first edge region and said second edge region thereby defining a flow channel between each plate and an adjacent plate; and wherein first, second and third successive plates within said stack are each arranged at an angle of 90° relative to a previous partition plate thereby defining a first flow channel, between the first and second plates, in a first direction and a second flow channel, between the second and third plates, in a second direction.

13. A plate heat exchanger according to claim 12, wherein each of said plurality of plates is identical.

14. A plate heat exchanger according to claim 12, wherein said folded edges comprise multiple folds on each edge, tightly stacked on one another.

15. A plate heat exchanger comprising:

a plurality of partition plates arranged in a stack, wherein each partition plate comprises (a) a center portion;

(b) a first edge region having a thickness greater than a thickness of said center portion, said greater thickness comprising a first folded over portion of said partition plate on a first side of the plate; and (c) a second edge region, opposite said first edge region, having a thickness greater than a thickness of said center portion, said greater thickness comprising a folded over portion of said partition plate on the same side of said plate as the first folded over portion; and wherein each of said folded over portions is folded over onto the partition plate surface;

wherein each plate is joined to an adjacent plate along said first edge region and said second edge region thereby defining a flow channel between each plate and an adjacent plate; and wherein successive plates within said stack are arranged at an angle of 90° relative to a previous partition plate thereby defining flow channels in a first direction and a second direction, wherein each partition plate further comprises:

(b) a third edge region having a thickness greater than a thickness of said center portion, said greater thickness comprising a first folded over portion of said partition plate on a second side of the plate; and (c) a fourth edge region, opposite said third edge region, having a thickness greater than a thickness of said center portion, said greater thickness comprising a folded over portion of said partition plate on the same side of said plate as the third folded over portion.

16. A plate heat exchanger according to claim 15, wherein said folded edges comprise multiple folds on each edge, tightly stacked on one another.

17. A plate heat exchanger according to claim 1, wherein said plates comprise a metallic sheet material.

18. A plate heat exchanger comprising:

a plurality of partition plates arranged (i) to form a plate block or a plate stack and (ii) to delimit, in alternating directions, layers of flow channels between adjacent partition plates within said plurality of partition plates; wherein a first partition plate comprises:

(a) a first main side;

(b) a second main side;

(c) a first folded edge which projects out of the plane of at least one of said main sides; and (d) a second folded edge, opposite said first folded edge, which projects out of the plane of the same main side as and in the same direction as said first folded edge;

a second partition plate comprises:

(a) a first main side;

(b) a second main side;

(c) a first folded edge which projects out of the plane of at least one of said main sides; and (d) a second folded edge, opposite said first folded edge, which projects out of the plane of the same main side as and in the same direction as said first folded edge, said second partition plate being joined to said first partition plate in a fluid-tight manner along said first and second folded edges of said first partition plate and spaced apart from said first partition plate by said first and said second folded edges of said first partition plate, thereby defining a flow channel layer between said first partition plate and said second partition plate; and wherein each of said folded edges is folded over onto the partition plate surface, wherein said plate block or plate stack comprises one of said first partition plates having one of said second partition plates being joined to both the first and the second main sides of said first partition plate in a fluid-tight manner along said first and second folded edges of said first or said second partition plate, and each second partition plate being spaced apart from said first partition plate by said first and said second folded edges, thereby defining a flow channel layer between said first partition plate and each of said second partition plates.

19. A plate heat exchanger according to claim 1, wherein each flow channel is separated from its adjacent flow channel(s) by only a single partition plate.

20. A plate heat exchanger according to claim 12, wherein each flow channel is separated from its adjacent flow channel(s) by only a single partition plate.

* * * * *